United States Patent [19]

Hopp et al.

[11] 4,041,629

[45] Aug. 16, 1977

[54] SIGNAL DEVICE

[75] Inventors: Philip Hopp, New York; Mort M. Allen, Bayside, both of N.Y.

[73] Assignee: The Hopp Press, Inc., New York, N.Y.

[21] Appl. No.: 676,417

[22] Filed: Apr. 13, 1976

[51] Int. Cl.[2] ..... G09F 13/04

[52] U.S. Cl. ..... 40/130 R; 40/145 R

[58] Field of Search ..... 40/130 R, 132 R, 77, 40/33, 152.2, 145 R, 128, 131 R

[56] References Cited

U.S. PATENT DOCUMENTS

| | | | |
|---|---|---|---|
| 1,740,845 | 12/1929 | Tilbe | 40/33 |
| 1,915,236 | 6/1933 | Messner et al. | 40/77 |
| 3,075,311 | 1/1963 | Maillette | 40/77 X |
| 3,105,315 | 10/1963 | Snethen | 40/77 |
| 3,313,056 | 4/1967 | Williams et al. | 40/77 |

FOREIGN PATENT DOCUMENTS

| | | | |
|---|---|---|---|
| 22,862 | 11/1914 | United Kingdom | 40/33 |

*Primary Examiner*—John F. Pitrelli

*Attorney, Agent, or Firm*—Kane, Dalsimer, Kane, Sullivan & Kurucz

[57] ABSTRACT

A signal device for use in connection with supermarket check-out counters to indicate check-out conditions at a particular location. The device includes a support pole and a housing mounted on the support pole. The housing is adapted to removably receive and hold a plurality of signal panels in position to be readily visually observed. The panels are interchangeable and have predetermined indicia thereon to enable the selection of a particular pattern to be observed while in the housing as a visual signal.

3 Claims, 3 Drawing Figures

SIGNAL DEVICE

BACKGROUND OF THE INVENTION

In public stores such as supermarkets it is often necessary to indicate certain conditions at check counters to facilitate the processing of shoppers as they pay for the goods. Accordingly, there is a need for a signal device that the shopper can see from a distance which indicates servie conditions at various check-out counters in the store as well as indicating which check-out counter are for particular uses, for example, express lanes or for a specific number of purchases.

Naturally it is also desirable, as well as having a readily observable signal device of this type, to have one which is adapted to readily receive different indicia so that the check-out counters can be rearranged for particular uses and to advise the customers accordingly.

SUMMARY OF THE INVENTION

With the above background in mind, it is among the primary objectives of the present invention to provide a signal device which is in the form of a housing on a pole high enough above the check-out counter while being mounted in position at the check-out counter so as to be readily observable. It has replaceable panels in the housing which indicate with appropriate colors and written indicia thereon identifying the counter and indicating what the particular counter is being used for at a particular point in time. It is useful in locating the check-out counters within the store for the customer and indicating express lines and other specific information. To enhance the visual observance of the particular housing, the panels are of different colors and include different indicia such as numbers and are illuminated by a light mounted on the pole interiorally of the housing and interconnected with an appropriate power source. In this manner, the panels within the housing are illuminated to further enhance visual ability.

Additionally the signal devices are provided with additional support means to mount other structures above the housing for ornamental purposes or to further enable the shoppers visual observance of the signal devices to locate the desired check-out counter. It should also be noted that the panels can be easily and quickly removed and mounted in place and can also contain other material such as store logos or sale information to the customers. The housing in one embodiment is circular in configuration to provide a 360° visual observation of the indicia contained thereon.

In summary, the signal device includes a support pole and a housing mounted on the support pole. There is means on the housing to removably receive and hold a plurality of signal panels in position to be readily visually observed. The panels are interchangeable and have predetermined indicia thereon to enable the selection of a predetermined pattern to be observed while in the housing as a visual signal.

With the above objectives among others in mind, reference is made to the attached drawings.

DESCRIPTION OF THE PREFERRED EMBODIMENT

Figure 1:
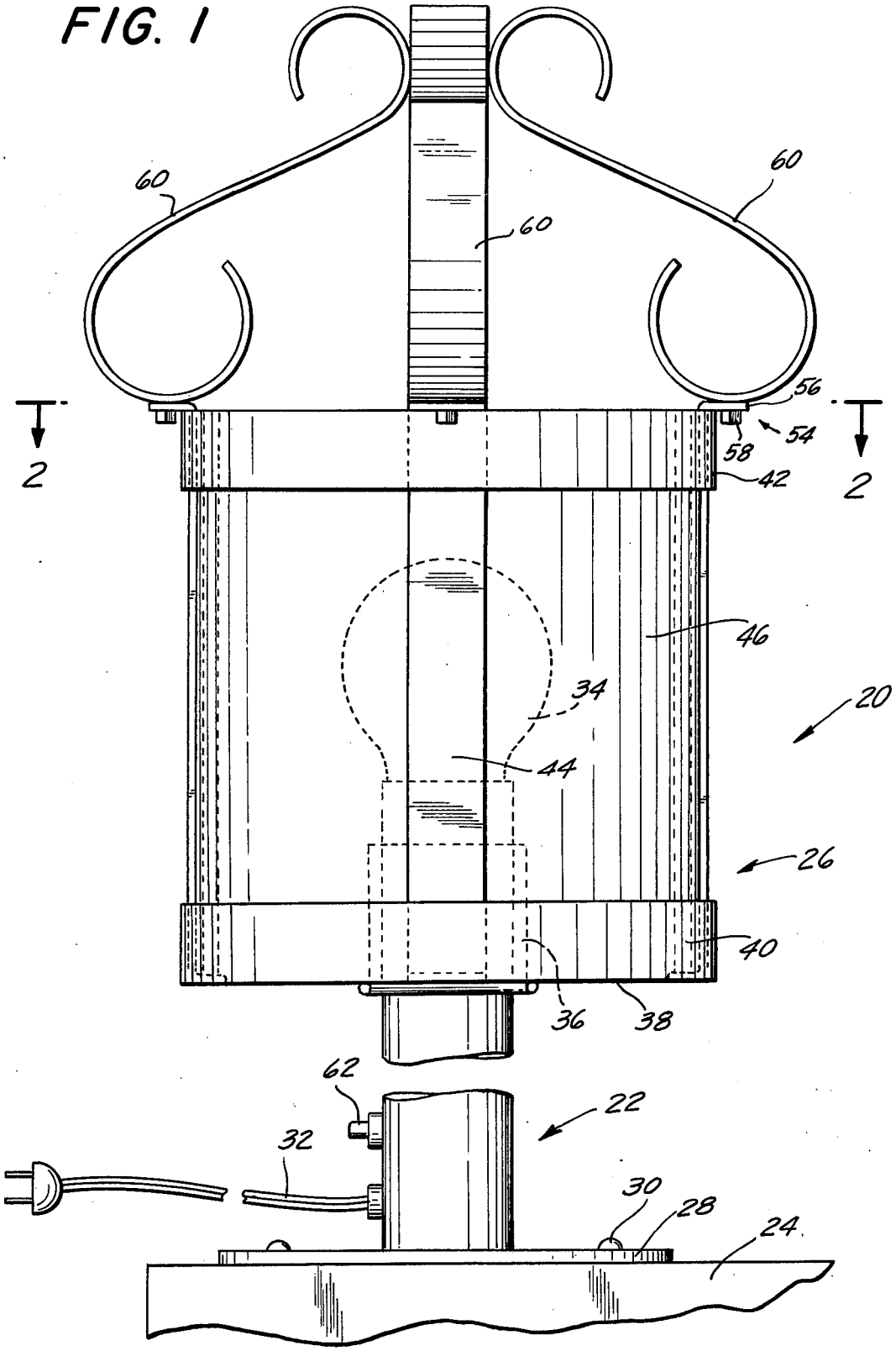
FIG. 1 is a side elevation view of the signal device of the invention with a portion of the pole having been removed.
Figure 2:
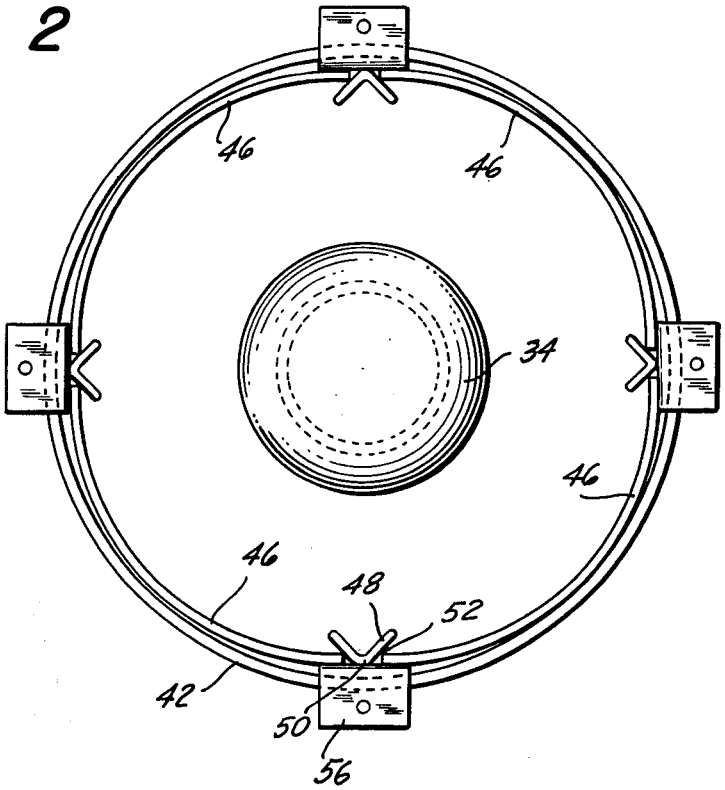
FIG. 2 is a top sectional view thereof taken along the plane of line 2—2 of FIG. 1.
Figure 3:
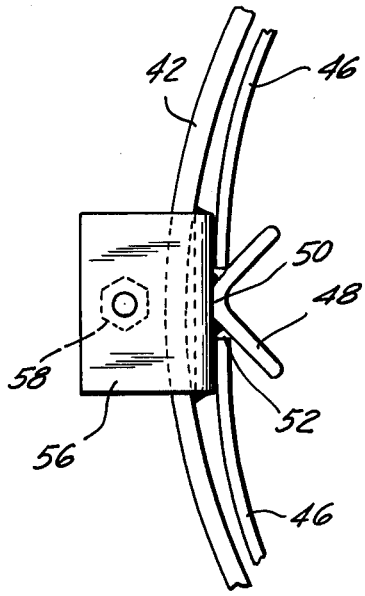
FIG. 3 is an enlarged fragmentary view of the support portion of the housing holding the panels in position as shown in FIG. 2.

Signal device 20 includes a vertical tubular support pole 22 mounted to a base 24 at the bottom end and having a housing arrangement 26 mounted at the upper end of the pole. The pole is mounted to base 24 in a conventional fashion such as by base plate 28 and appropriate bolts 30. Adjacent to base 24 is a connected cord 32 which has a plug on the terminal end for introduction to an outlet as a source of electrical energy. The wiring extends upward through the pole and is interconnected with a light bulb 34 which is positioned within the housing 26.

Pole 22 is of a conventional metal material such as wrought iron, aluminum or steel and is tubular and hollow to accept the wires therethrough and to receive the light bulb 34 in the upper end thereof in an appropriate socket 36. The housing is mounted on the pole 22 and includes a circular base 38 having an upwardly extending annular band. Base 38 and upwardly extending skirt on annular band 40 form a dish for receiving the remainder of the housing structure and the panels. Vertically spaced above band 40 is another annular band 42 which forms the upper end of the housing. The bands are interconnected by four annularly spaced vertical strips or members 44 which are uniformally spaced about the circumference of the bands and interconnected therewith in a conventional fashion such as by weldingg. The pole is also connected to the housing in a conventional manner such as by welding or bolting the components together.

Band 42 is open at the top to permit the insertion and removal of four panels 46. To assist in retaining the panels in position V-shaped support bracket 48 are provided. Each V-shaped bracket is welded at its apex 50 to a vertical member 44 at the point where the vertical member meets the upper band 42. The legs of each V-shaped bracket extend angularly inward from the inner surface of band 42 so as to form a receiving recess on both sides of the apex. Each recess 52 cooperates with the corresponding recess of an adjacent bracket 48 to retain a panel 46 in position along with the portion of band 42 therebetween and the base 38 and lower band 40 which support the bottom end of panels 46. The panels are constituted of a preformed arcuate configuration or preferably of a flexible plastic material so that they can be arcuately bent to fit between apexes of adjacent support brackets 48 to be held in position by legs of adjacent brackets 48 and flexed into engagement with band 42. As stated the bottom of each plastic panel is suported by base 38 and band 40 in the flexed condition. With four brackets 48 about the circumference of the housing 26 and spaced at approximately 90° intervals there is room for four panels 46 to be positioned in adjacent relationship. The panels are observable from the exterior of the housing since they are located between each pair of adjacent vertical strips or members 44. The panels which are constructed of plastic material can be of a variety of different colors and can have appropriate indicia placed thereon such the logo of a store, numbers or appropriate lettering. The colored panels are illuminated by light 34 within the housing which is lighted by electrical connector 32 at the bottom of the pole. The height of pole 22 is such that housing 26, with the panels in position, is at least at eye level and readily observable from a distance to facilitate the viewers identification of the location and markings on the housing panels. It has been found that a pole of approximately 5 feet in height works effectively in providing a readily observable housing for identification.

Panels 46 can be easily slipped out of and into the housing through the upper end thereof which is open and fitted between the two brackets 48 which are adjacent to one another by merely flexing the plastic panels 46 so that they conform to the configuration of the recess formed by the brackets and the adjacent band 42. As started above, instead of flexible plastic panels 46 the panels can be formed in an initial arcuate configuration so as to fit th e recess without having to be flexed into position. In any event, the panels can be easily slipped into and out of the recess and accordingly are readily interchangeable in position within the housing.

Also mounted on the housing are four angularly spaced L-brackets 54 which are in alignment with the brackets 48 and the vertical strips 44.

The L-brackets 54 have a laterally extending leg 56 which extends outwardly from the top of band 42 and has an appropriate aperture therein to receive a fastener such as a bolt 58 therethrough to mount a top structure 60 thereon. The other leg of the L-bracket 54 is mounted in a conventional fashion to band 42 such as by welding. In this manner, the L-brackets 54 provide means to mount a top structure 60 to the housing and provide an ornamental arrangement to the top of the housing or an additional visually observable structure for a person such as a shopper to see at a distance and recognize.

While it has been found to be preferable to manufacture the panels 46 of the flexible plastic, it is also possible to have the panels of a rigid plastic or glass material which would be affected in the same manner by the light 34 as the plastic panels. Additionally, while virtually a large number of metals or plastics are employable for the remainder of the structure of device 20, it has been found that wrought iron works effectively and provides a pleasing and functional assembly for the device. The wrought iron components include the pole 22, housing 26 with the exception of the panels, and the top ornament 60.

An appropriate switch 62 can be provided on the pole, for example near the base of the pole where the operator at the check-out counter can turn the light 34 on and off as desired to provide further indication means as to the use of a particular check-out counter or to make the visual indicia on the panels in the housing more readily observable at a distance.

While in the embodiment depicted there are four vertical strips, four panels, four V-shaped support brackets and four L-brackets, it is possible to alter the number of these elements. Appropriate accompanying support structure can be provided to function in the same manner as in the depicted and described embodiment. It should also be understood that in place of the lamp 34 other substitute illumination means can be used to accomplish the same result in illuminating the panels in the housing as desired.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A signal device comprising; a support pole, a housing on the support pole, the housing being in the form of a cage with the bottom being disc-shaped and mounted to the top of the pole and having an upwardly extending annular skirt and the top being a circular band aligned with the annular skirt of the bottom, a plurality of spaced vertical ribs connected at one end to the bottom disc and at the other end to the circular band and the ribs being spaced to provide viewing apertures therebetween, means on the housing to removably receive and hold a a plurality of signal panels in position to be readily visually observable through the viewing apertures and being held in arcuate configuration so as to conform to the portion of the circular configuration of the housing where each panel is located, the panels being of deformable plastic material to facilitate their alteration of configuration to engage with the means on the housing in the desired position for visual observance through the appropriate viewing aperture, the panels being interchangeable and having predetermined indicia to enable the selection of a particular pattern to be observed while in the housing as a visual signal, the means on the housing to removably receive the panels includes a support bracket in alignment with each vertical member and attached to the housing at the location of the band, the bracket extending inwardly of the housing, each bracket cooperating with an adjacent bracket and the adjacent housing structure to receive a panel therebetween in deformed arcuate configuration and cooperate with the base of the housing to hold the panel in position for visual observance between the vertical members, a light source is mounted on the pole and positioned within the housing so as to illuminate the panels in position in the housing and enhance visual observance thereof from a distance, means being attached to the bottom of the pole to permit interconnection to a source of electrical energy to illuminate the light mounted at the top of the pole, the pole having support means to facilitate its ability to be placed in an upright position and the pole being of a predetermined length to position the housing when the pole is in the upright position in a high location to permit its visual observance from a distance.

2. The invention in accordance with claim 1 wherein the signal device is adapted to be positioned adjacent to supermarket check-out counters so as to provide a visual signal to shoppers as to check-out conditions at a particular counter.

3. The invention in accordance with claim 1 wherein a laterally extending bracket is attached to the top of the housing to permit the mounting of an additional structural element above the housing and the pole and housing are of wrought iron material.

* * * * *